US007758024B2

(12) United States Patent
Takahashi et al.

(10) Patent No.: US 7,758,024 B2
(45) Date of Patent: Jul. 20, 2010

(54) MICROBUBBLE GENERATING DEVICE AND HAIR WASHING DEVICE UTILIZING THE SAME

(75) Inventors: Tsunejiro Takahashi, Tokyo (JP); Toshitaka Okumura, Yokohama (JP); Koichi Kubo, Tokyo (JP)

(73) Assignee: Shoei Butsuryu Co., Ltd. (JP)

( * ) Notice: Subject to any disclaimer, the term of this patent is extended or adjusted under 35 U.S.C. 154(b) by 947 days.

(21) Appl. No.: 11/580,851

(22) Filed: Oct. 16, 2006

(65) Prior Publication Data

US 2007/0108640 A1 May 17, 2007

(30) Foreign Application Priority Data

Nov. 11, 2005 (JP) ..... 2005-327849

(51) Int. Cl.
*B01F 3/04* (2006.01)

(52) U.S. Cl. ..... 261/28; 4/516; 4/517; 4/518; 261/65; 261/76; 261/DIG. 75

(58) Field of Classification Search ..... 261/28, 261/65, 76, 119.1, 123, DIG. 75; 4/516–517
See application file for complete search history.

(56) References Cited

U.S. PATENT DOCUMENTS

| | | | | |
|---|---|---|---|---|
| 1,808,956 | A * | 6/1931 | Ketterer | 261/77 |
| 2,521,215 | A * | 9/1950 | Haddeland et al. | 261/36.1 |
| 4,000,227 | A * | 12/1976 | Garrett | 261/93 |
| 4,419,775 | A * | 12/1983 | Ebert | 4/541.4 |
| 4,602,391 | A * | 7/1986 | Shepherd | 4/541.4 |
| 4,766,001 | A * | 8/1988 | Mizandjian et al. | 426/477 |
| 5,014,371 | A * | 5/1991 | Heel | 4/516 |

(Continued)

FOREIGN PATENT DOCUMENTS

JP 1-284626 A * 11/1989

(Continued)

*Primary Examiner*—Richard L Chiesa
(74) *Attorney, Agent, or Firm*—NDQ&M Watchstone LLP

(57) ABSTRACT

A dissolving water making unit and a bubble generating unit are provided. The dissolving water making unit includes a gas dissolving device for dissolving gas in water. The bubble generating unit includes a bubble generating nozzle and a bubble generating cartridge. The dissolving water making unit sucks water from a water source, and sucks gas to make dissolving water from a mixed solution in which the water and the gas are mixed together. The dissolving water is obtained by dissolving the gas in the water. The bubble generating unit generates microbubbles from the dissolving water supplied from the dissolving water making unit. The gas dissolving device includes a closed vessel; an inflow port which is provided in the closed vessel, and which is provided for causing the mixed liquid sucked from the source to flow into the closed vessel; an exhaust valve which is provided in an upper portion of the closed vessel, and which is provided for exhausting excess gas from the mixed liquid; and an outflow port which is provided near a bottom portion of the closed vessel, and which is provided for causing the dissolving water to flow out from the closed vessel to the bubble generating unit. Between the inflow port and the outflow port, the closed vessel has a retention region in which the dissolving water flows slowly, in which air is dissolved in the dissolving water to substantial saturation, and in which the dissolving water hardly contains fine bubbles.

6 Claims, 3 Drawing Sheets

U.S. PATENT DOCUMENTS

| | | | | |
|---|---|---|---|---|
| 5,167,806 | A * | 12/1992 | Wang et al. | 210/188 |
| 5,246,633 | A * | 9/1993 | Teng | 261/36.1 |
| 5,314,644 | A * | 5/1994 | Michelsen et al. | 261/84 |
| 5,951,921 | A * | 9/1999 | Koganezawa et al. | 261/36.1 |
| 6,264,174 | B1 * | 7/2001 | Chang et al. | 261/29 |
| 7,171,704 | B2 * | 2/2007 | Johnson | 4/518 |
| 2002/0162803 | A1 * | 11/2002 | Haney et al. | 210/748 |

FOREIGN PATENT DOCUMENTS

| | | | |
|---|---|---|---|
| JP | 2516695 | | 8/1996 |
| JP | 2003-265938 | A | 9/2003 |
| JP | 2005-102852 | A | 4/2005 |
| WO | WO 99/09265 | | 2/1999 |

* cited by examiner

MICROBUBBLE GENERATING DEVICE AND HAIR WASHING DEVICE UTILIZING THE SAME

CROSS-REFERENCE TO RELATED APPLICATION

This application is based upon and claims the benefit of priority from the prior Japanese Application No. 2005-327849, filed on Nov. 11, 2005; the entire contents of which are incorporated herein by reference.

BACKGROUND OF THE INVENTION

1. Field of the Invention

The present invention relates to a microbubble generating device for generating microbubbles having diameters of approximately 1 μm to 50 μm, and relates to a hair washing device utilizing the microbubble generating device.

2. Description of the Related Art

In Japanese Patent Application Laid-open Publication No. 2003-265938, a microbubble generating device sucks water in a bathtub using a pump. Thereafter, using a compressor, the device presses air into water which is transported under pressure by the pump. Accordingly, a mixed liquid, in which water and the air are mixed together, is made. Then, the microbubble generating device introduces the mixed liquid into a gas dissolving device to make dissolving water from which excess air is expelled. Subsequently, the microbubble generating device discharges the dissolving water through a nozzle into, for example, the bathtub. Thereby, the dissolved gas is caused to appear as fine bubbles.

In Japanese Registered Utility Model Publication No. 2516695, a hair washing device for washing the human hair has a constitution in which a shower is sprayed from a nozzle into a watertight base configured to cover the head, and in which shampoo liquid is used.

The gas dissolving device of the microbubble generating device has a closed vessel. The closed vessel has a partition plate extending from a lower portion thereof to the vicinity of an upper end thereof. Thereby, the inside of the vessel is divided into a first agitating and mixing passage and a second agitating and mixing passage. In the gas dissolving device, mixed water made by mixing water and air together is drawn in the first agitating and mixing passage through an inflow port provided in a lower portion thereof, passes over the partition plate to flow into the second agitating and mixing passage, and flows out through an outflow port provided in a lower portion of the second agitating and mixing passage. In order to exhaust excess air in the mixed water, an air vent valve is provided in an upper portion of the vessel.

In the above-described constitution, dissolving water, in which air is dissolved in water, can be made. In this event, a relatively fast water stream is formed in the vessel. Specifically, the water stream rises from the inflow port within the first agitating and mixing passage, passes over the partition plate, falls within the second agitating and mixing passage, and reaches the outflow port in the lower portion. As a result, there are cases where the dissolving water is exhausted through the outflow port in a state in which excess air remains in the dissolving water, or in which fine bubbles carried by the flow of water remain contained therein.

Accordingly, when the dissolving water is discharged through the nozzle to generate fine microbubbles, bubbles, which have very large diameters compared to the microbubbles, are generated in some cases. For this reason, a further improvement has been desired in maintaining the diameters of fine microbubbles uniform.

In the hair washing device, a shower is merely sprayed on the head, and therefore has a problem that it is difficult to sufficiently wash, for example, the scalp.

SUMMARY OF THE INVENTION

The present invention has been made to solve the above-described problems of the related art. An object of the present invention is to provide a bubble generating device with which uniform microbubbles can be generated, and to provide a hair washing device utilizing the same.

To achieve the above object, a first aspect of the present invention is a microbubble generating device comprising a source of water, a dissolving water making unit and a bubble generating unit. The dissolving water making unit sucks gas as well as the water of the source, and makes dissolving water in which the gas is dissolved in the water, from a mixed liquid in which the water and the gas are mixed together. The dissolving water making unit includes a gas dissolving device for dissolving the gas in the water. The bubble generating unit generates microbubbles from the dissolving water supplied from the dissolving water making unit.

Here, the gas dissolving device includes a closed vessel; an inflow port which is provided in the closed vessel, and which is provided for causing the mixed liquid sucked from the source to flow into the closed vessel; an exhaust valve which is provided in an upper portion of the closed vessel, and which is provided for exhausting excess gas from the mixed liquid; and an outflow port which is provided near a bottom portion of the closed vessel, and which is provided for causing the dissolving water to flow out from the closed vessel to the bubble generating unit. The closed vessel has a retention region between the inflow port and the outflow port. The retention region is where the dissolving water flows slowly, where air is dissolved in the dissolving water to substantial saturation, and where the dissolving water hardly contains fine bubbles.

According to the first aspect of the present invention, mixed water, in which water and gas are mixed together, is drawn into the closed vessel to make dissolved water, the outflow port for causing the dissolving water to flow out is provided near the bottom portion of the closed vessel, and the retention region, in which the dissolving water flows slowly, is provided at a position between the inflow port and the outflow port. Accordingly, excess gas in the dissolving water can be sufficiently removed, and the diameters of bubbles can be made substantially uniform when the dissolving water is discharged through a nozzle to generate fine bubbles.

The bubble generating unit may include a bubble generating nozzle; and a bubble generating cartridge detachably attached to a nozzle body of the bubble generating nozzle. The bubble generating cartridge includes an orifice, a net member, and a pressure relief chamber. The nozzle body has an agitating chamber formed therein.

The above-described constitution makes it possible to change the gas (air) dissolved in the dissolving water into finer bubbles.

The inflow port may be submerged in water stored in the closed vessel, and the outflow port may face toward the bottom portion of the closed vessel.

The gas dissolving device may include, in the closed vessel, a static member for preventing the dissolving water near the outflow port from being agitated by momentum of flow of the mixed liquid flowing in through the inflow port.

In the above-described constitution, the static member has an action of facilitating the formation of the retention region by preventing the occurrence of a relatively fast water stream reaching from the inflow port directly to the outflow port. Accordingly, the closed vessel can be miniaturized.

A second aspect of the present invention has a gist that a hair washing device, which utilizes the microbubble generating device of the first aspect, includes a hair washing bowl. The hair washing bowl has an opening portion where a head of a user can be accepted, and includes the bubble generating unit and an exhaust port for exhausting water from the hair washing bowl. The head is cleaned with the microbubbles.

According to the second aspect of the present invention, since the microbubble generating device is employed in the hair washing device, microbubbles generated in the hair washing bowl adhere to hair to float the hair. Accordingly, the microbubbles in the hair washing bowl reach scalp, and the scalp can be effectively cleaned by an effect of microbubbles.

DESCRIPTION OF THE PREFERRED EMBODIMENT

Figure 1:
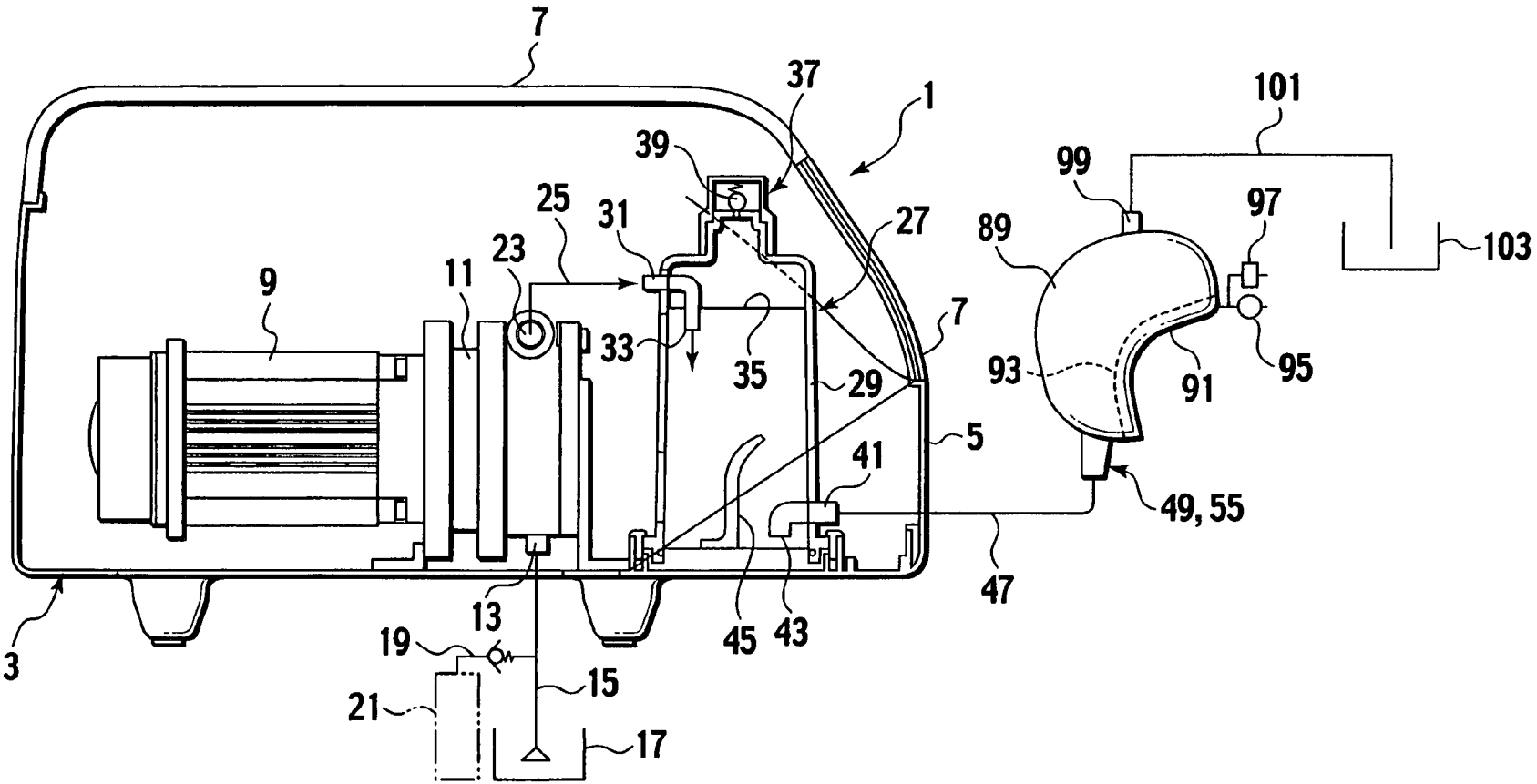
FIG. 1 is an explanatory, conceptual and schematic view of a microbubble generating device according to an embodiment of the present invention.

Hereinafter, an embodiment of the present invention will be described with reference to the drawings. In the description below of the drawings, the identical or similar components are denoted by the identical or similar reference numerals. It should be noted, however, that the drawings are schematic, and that the relationship between thicknesses and plane dimensions, the proportions of the thicknesses of layers and the like differ from those of actual ones. In addition, the embodiment described below exemplifies an device for embodying technical principles of the present invention. The technical principles of the present invention do not limit the materials, shapes, structures, arrangement, and the like, of components to undermentioned ones. The technical principles of the present invention allow various modifications to be made within the scope of claims.

As shown in FIG. 1, a microbubble generating device 1 according to the embodiment of the present invention includes a portable casing 3. The casing 3 has a constitution in which a cover member 7 is provided onto a box-shaped casing body 5 in a way that the cover member 7 can be opened or closed. In the casing body 5, a pump 11, which is rotationally driven by a small motor 9, is placed. The pump 11 is an appropriate pump such as a regenerative pump or a cascade pump. An inlet port 13 of the pump 11 is connected through an inlet passage 15 to a reservoir 17 in which water is stored.

As the reservoir 17, for example, a bathtub can be used. In a case where the inlet passage 15 is connected to a water source such as a water pipe or a water heater, the water source corresponds to the reservoir 17. In order to mix air with water sucked into the pump 11 to make mixed water (mixed liquid), a gas inlet passage 19 for sucking outside air is connected to a middle of the inlet passage 15 to form a branch connection. In the inlet passage 15, negative pressure is created due to the suction of the pump 11. Accordingly, connecting the gas inlet passage 19 to the inlet passage 15 makes it possible to provide a constitution for sucking outside air (air) from the gas inlet passage 19 into the inlet passage 15.

In a case where carbonic acid gas is to be dissolved in water, a carbonic acid gas cylinder 21 may be connected to the gas inlet passage 19.

An outlet port 23 of the pump 11 is connected, through a connecting passage 25, to a gas dissolving device 27. The gas dissolving device 27 includes a closed vessel 29 which is sealed, and constitutes a dissolving water making unit together with the pump 11 and the like. In an appropriate position in the closed vessel 29, the position being in an upper portion of the closed vessel 29 in the embodiment of the present invention, an inflow pipe 31, which is connected to the connecting passage 25, is provided. An inner end portion (inflow port) 33 of the inflow pipe 31 is submerged under a surface 35 of water (mixed liquid) stored in the closed vessel 29, i.e., submerged in the water in the closed vessel 29.

In an upper portion of the closed vessel 29, an exhaust valve 37 is provided to exhaust excess gas contained in the mixed liquid (mixed water) drawn into the closed vessel 29 by the pump 11. The exhaust valve 37 has a function of exhausting excess gas (air) from the upper portion of the closed vessel 29 as well as having a function of maintaining the pressure in the closed vessel 29 at a predetermined pressure. The exhaust valve 37 is, for example, a check valve including a valve element 39 such as a ball. An exhaust hole of this check valve is formed to be a very small hole so that the pressure in the closed vessel 29 does not greatly decrease.

Near a bottom portion of the closed vessel 29, an outflow pipe 41 is provided to cause dissolving water in the closed vessel 29 to flow out. An entrance (outflow port) 43 of the outflow pipe 41 faces toward the bottom portion (lower side) of the closed vessel 29. The bottom portion of the closed vessel 29 and the outflow port 43 of the outflow pipe 41 have a slight gap therebetween. A retention region is formed between the inner end portion (inflow port) 33 of the inflow pipe 31 and the outflow pipe 41. The retention region, which extends from the inflow port 33 of the inflow pipe 31 to the outflow port 43 of the outflow pipe 41, is a slow flow region in which the flow rate of water is very low.

In other words, the retention region is a region in which water flowing into the closed vessel 29 through the inflow port 33 is in a substantially retained condition. The retention region is a region where the momentum of the dynamic flow of water flowing in through the inflow port 33 is reduced to temporarily establish a stagnant condition in which a static flow is formed. Water in the retention region described above is exhausted to the outside through the outflow pipe 41.

In order to prevent the outflow pipe 41 from being affected by the momentum of a water stream flowing from the inflow pipe 31, a plate-shaped static member 45 is provided in the closed vessel 29. The static member 45 has an action of facilitating the formation of the retention region by preventing the occurrence of a relatively fast water stream reaching from the inflow pipe 31 directly to the outflow pipe 41 when the inlet velocity of water from the inflow pipe 31 is high. Accordingly, in a case where the inlet velocity of water flowing in from the inflow pipe 31 is low, or where the volume of the closed vessel 29 is large compared to the amount of water flowing in per unit time, the static member 45 can be omitted. In other words, by providing the static member 45, the closed vessel 29 can be miniaturized.

Figure 2:
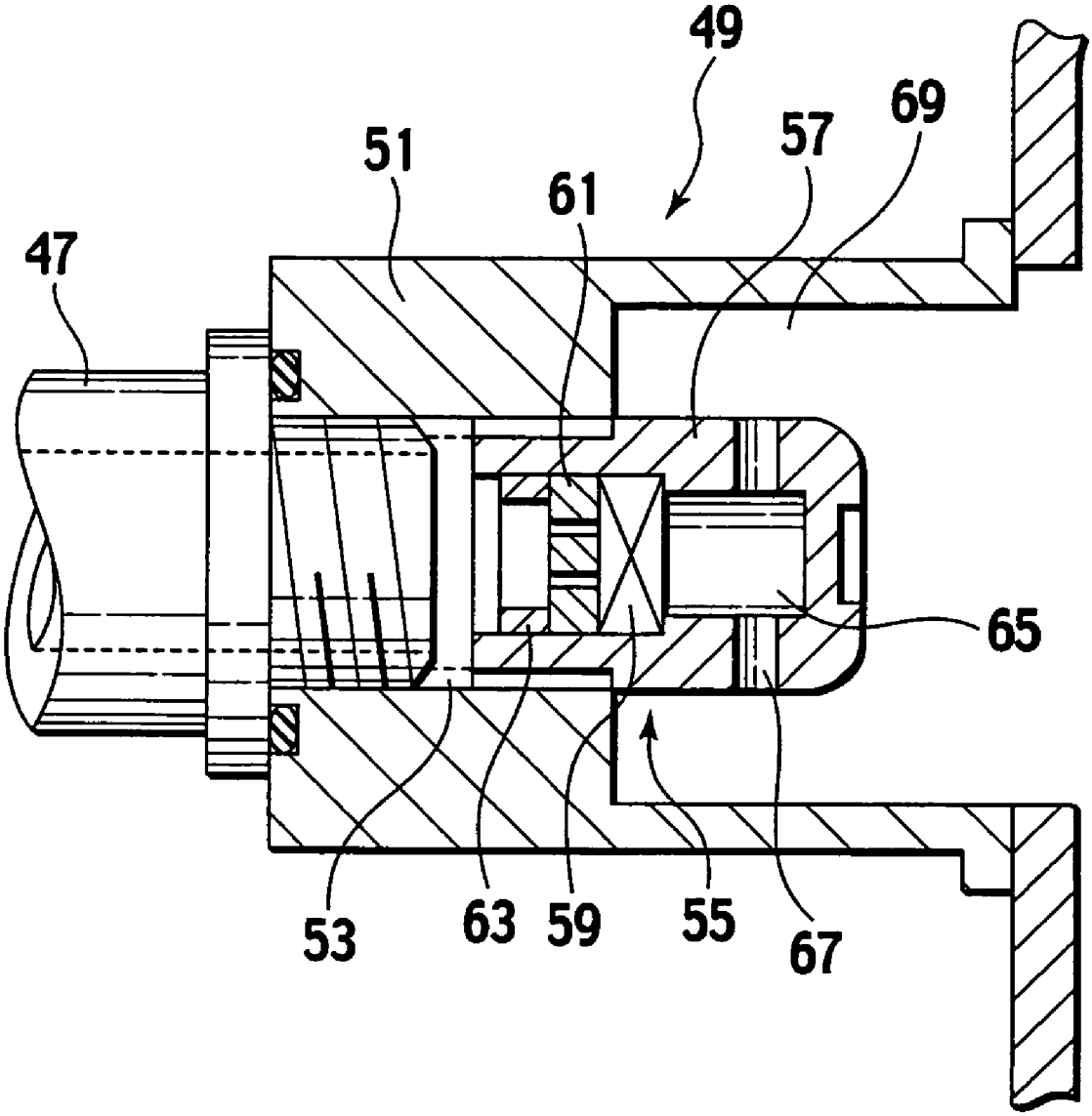
FIG. 2 is an explanatory cross-sectional view of a nozzle according to the embodiment of the present invention.

To the outflow pipe 41, a bubble generating nozzle 49 is connected through a connecting passage (connecting pipe) 47. As shown in FIG. 2, the nozzle 49 includes a nozzle body 51 to which the connecting pipe 47 is connected. In the nozzle body 51, a bubble generating cartridge 55 is detachably attached to a communicating hole 53, which is in communication with the connecting pipe 47. The bubble generating nozzle 49 constitutes a bubble generating unit together with the babble generating cartridge 55 and the like.

More specifically, the bubble generating cartridge 55 includes the cylindrical cartridge body 57 in a shape an end of which is closed with a wall portion, and a different end of which is opened. In the cartridge body 57, a fine-mesh net member 59 and an orifice 61, which has an appropriate number of small holes, are detachably fixed with a ring-shaped fixing member 63 such as a ring-shaped nut or a snap ring inserted and screwed in order into the opening at the different end of the cartridge body 57. A pressure relief chamber 65 is provided between the wall portion at the end of the cartridge body 57 and the net member 59. The peripheral wall of the pressure relief chamber 65 has a plurality of through holes 67 formed therein.

The end of the cartridge body 57 protrudes, through the communicating hole 53 of the nozzle body 51, toward the inside of an agitating chamber 69 which is a large-diameter hole formed in the nozzle body 51. The through holes 67 of the cartridge body 57 are in communication with the agitating chamber 69.

In the above-described constitution, when the motor 9 is driven to rotationally drive the pump 11, water in the reservoir 17 is sucked through the inlet passage 15, and air is sucked through the gas inlet passage 19. In the case where the carbonic acid gas cylinder 21 is connected to the gas inlet passage 19, carbonic acid gas is sucked.

The water and gas, such as air, which are sucked into the pump 11, are agitated and mixed within the pump 11. The water, in which part of the air is dissolved, is injected downward from the inflow port 33 of the inflow pipe 31 into the closed vessel 29 of the gas dissolving device 27. Near an upper portion of the inside of the closed vessel 29, the injected water agitates water in the upper portion. Thereby, air is dissolved in the water in the upper portion. At this time, excess air, which is not dissolved in water, rises and collects above the surface 35 of water in the closed vessel 29 to be exhausted, through the exhaust valve 37, to the outside. The pressure in the closed vessel 29 is always maintained at a pressure higher than the ambient pressure.

A region near the bottom portion of the closed vessel 29 is in a static and retained condition in which agitation by water flowing in through the inflow pipe 31 does not occur, i.e., in a state in which flow is slow enough not to cause contained suspended matters to rise or flow into the inflow pipe 31. Water near this bottom portion is dissolving water in a state where air is dissolved to substantial saturation, and where fine bubbles are not contained. Accordingly, the dissolving water near the bottom portion is dissolving water from which excess air is removed, and which does not contain fine bubbles carried on the flow of water. This dissolving water is supplied to the bubble generating nozzle 49 through the outflow pipe 41 and the connecting pipe 47.

Pressure is released after the dissolving water flowing through the connecting pipe 47 into the nozzle 49 passes through the small holes of the orifice 61. Accordingly, the gas (air) dissolved in the dissolving water appears as fine bubbles. The fine bubbles thus appeared are further fined with the net member 59 to be injected into the pressure relief chamber 65. Since the pressure of the dissolving water is further released in the pressure relief chamber 65, the dissolved gas further appears as fine bubbles, which hit against the wall portion at one end of the pressure relief chamber 65 to be further fined.

The dissolving water injected from the pressure relief chamber 65 through the through holes 67 into the agitating chamber 69 causes fine bubbles to be further generated upon further pressure release. The generated fine bubbles are fined by an agitating action to be microbubbles having diameters of approximately 1 μm to 50 μm, and are injected to the outside.

As described above, the dissolving water supplied from the gas dissolving device 27 to the nozzle 49 is in a state in which excess air is removed, and does not contain fine bubbles carried on the flow of water. Thereby, substantially uniform microbubbles can be generated, and microbubbles do not rise with the rise of bubbles having relatively large diameters. Thus, the length of time for which microbubbles float in water can be increased, and an effect of microbubbles can be maintained for a long period of time.

Figure 3:
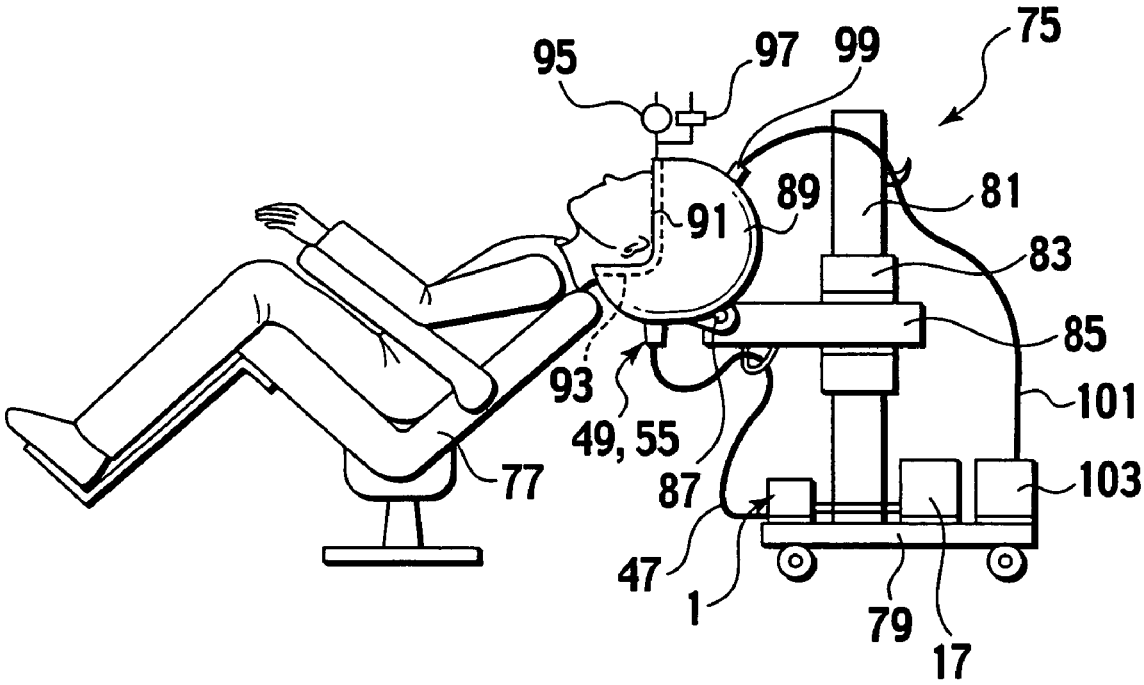
FIG. 3 is an explanatory view of a hair washing device utilizing the microbubble generating device according to the embodiment of the present invention.

FIG. 3 conceptually and schematically shows the constitution of a hair washing device 75 utilizing the above-described microbubble generating device 1. Components having the identical functions as above-described ones are denoted by the identical reference numerals, and will not be further described.

The hair washing device 75 includes a movable carriage 79 movable in a direction in which the movable carriage 79 moves closer to or away from a seat 77 occupied by a person to be shampooed. The movable carriage 79 has a support 81 which is stood thereon, and to which an elevating member 83 is attached in such a manner that the vertical position thereof can be adjusted. The elevating member 83 supports a slide member 85 in such a manner that the slide member 85 can be moved and adjusted in a horizontal direction. On a tip portion of the slide member 85, a hair washing bowl 89 is supported with a pivot 87 interposed therebetween in such a manner that the hair washing bowl 89 can be swung (rotationally moved) and adjusted in the vertical direction.

The hair washing bowl 89 includes an opening portion 91 in which the head of the person occupying the seat 77 can be accepted. An annular air tube 93 placed along the opening portion 91 is provided Inside the opening portion 91. An air pump 95 for pumping air in the air tube 93 is connected to the air tube 93, and an on-off valve 97, with which air in the air tube 93 can be exhausted, is also connected.

The bubble generating nozzle 49 is attached to a lower portion of the hair washing bowl 89. An exhaust port 99 for exhausting water from the hair washing bowl 89 is provided in an upper portion of the hair washing bowl 89. The exhaust port 99 is connected, through an exhaust pipe 101, to a waste water tank 103. The reservoir 17, the microbubble generating device 1, and the waste water tank 103 are placed on the movable carriage 79.

In the above-described constitution, the vertical position of the hair washing bowl 89, the lateral position thereof in FIG. 3, and the position of the opening portion 91 of the hair washing bowl 89 are adjusted to the position of the head of a person to be shampooed. After the head of the person to be shampooed is accepted in the opening portion 91, air is pumped into the air tube 93 by operating the air pump 95 in a state in which the on-off valve 97 is closed. Thereby, the air tube 93 is expanded to be brought into tight contact with the head. Thereafter, when the microbubble generating device 1 is driven, microbubbles emerge from the bubble generating nozzle 49 into the hair washing bowl 89 as described previously. Overflowing water is exhausted, through the exhaust port 99, to the waste water tank 103.

As described previously, when microbubbles having diameters of approximately 1 μm to 50 μm emerge into the hair washing bowl 89, the microbubbles adhere to the hair to float the hair. Accordingly, microbubbles supplied one after another come into direct contact with the scalp to clean the scalp and the hair. Microbubbles generate ultrasonic waves when burst. Furthermore, microbubbles shrink due to a self-pressurizing effect, and cause a phenomenon called collapse at an instant at which shrunk microbubbles disappear. In this phenomenon of collapse, an adiabatic compression-like action is produced. Thereby, a region with a temperature of several thousands of degrees Celsius and with a pressure of several thousands of atmospheres is formed to be a very small region. In this very small region, microbubbles generate free radicals such as —OH. That is, by utilizing the above-described ultrahigh temperature and free radicals, various chemicals in an aqueous solution can be decomposed, and hair and the scalp can be effectively cleaned without using shampoo.

As described above, the present invention has been described using an embodiment. However, the present invention is not limited to the above embodiment. Each component can be replaced by a component having an arbitrary constitution and the similar function. The present invention can be carried out in other forms by making appropriate modifications.

For example, in the embodiment of the present invention, the descriptions have been provided for an example in which the hair washing bowl 89 is movably provided on the movable carriage 79 provided independently of the seat 77. However, a guide portion corresponding to the support 81 may be provided on the seat 77, and the hair washing bowl 89 may be provided on an elevating member vertically movable along the guide portion in such a manner that the hair washing bowl 89 can be moved and swung in a direction perpendicular to the direction of movement of the elevating member. The seat 77, the support 81, and the like may be combined to be integrated, i.e., the hair washing bowl 89 may be provided on the seat 77 so that the hair washing bowl 89 can be moved vertically and swung. Although an example, in which the human head is cleaned, has been described in the embodiment of the present invention, a device for cleaning the head of an animal other than that of a human is also possible.

What is claimed is:

1. A microbubble generating device comprising:

a source of water;

a dissolving water making unit for sucking the water of the source and gas, and for making dissolving water in which the gas is dissolved in the water from a mixed liquid in which the water and the gas are mixed together, wherein the dissolving water making unit includes a gas dissolving device for dissolving the gas in the water; and a bubble generating unit for generating microbubbles from the dissolving water supplied from the dissolving water making unit, wherein the gas dissolving device includes a closed vessel;

an inflow port provided in the closed vessel and for causing the mixed liquid sucked from the source to flow into the closed vessel;

an exhaust valve provided in an upper portion of the closed vessel and for exhausting excess gas from the mixed liquid; and an outflow port provided near a bottom portion of the closed vessel and for causing the dissolving water to flow out from the closed vessel to the bubble generating unit, and wherein between the incoming port and the outgoing port, the closed vessel includes a retention region in which the dissolving water flows slowly, air is dissolved in the dissolving water to substantial saturation, and the dissolving water hardly contains fine bubbles.

2. The microbubble generating device according to claim 1, wherein the bubble generating unit includes:

a bubble generating nozzle; and a bubble generating cartridge detachably attached to a nozzle body of the bubble generating nozzle, the nozzle body having an agitating chamber formed therein, the bubble generating cartridge including an orifice, a net member, and a pressure relief chamber.

3. The microbubble generating device according to claim 2, wherein the inflow port is submerged in water stored in the closed vessel, and the outflow port faces toward the bottom portion of the closed vessel.

4. The microbubble generating device according to claim 1, wherein the gas dissolving device comprises a static member in the closed vessel, the static member preventing the dissolving water near the outflow port from being agitated by momentum of flow of the mixed liquid flowing in through the inflow port.

5. A hair washing device utilizing the microbubble generating device according to claim 1, the hair washing device comprising a hair washing bowl having an opening portion acceptable for a head of a user and including the bubble generating unit and an exhaust port for exhausting water from the hair washing bowl, wherein the head is cleaned by the microbubbles.

6. The hair washing device utilizing the microbubble generating device according to claim 5, wherein the bubble generating unit is provided in a lower portion of the hair washing bowl, and the exhaust port is provided in an upper portion of the hair washing bowl.

* * * * *